US008851203B2

(12) United States Patent
Smith et al.

(10) Patent No.: US 8,851,203 B2
(45) Date of Patent: Oct. 7, 2014

(54) SONIC DRILL HEAD

(75) Inventors: Brian Smith, Baxter, MN (US); Krasimir Zahariev, Chicago, IL (US); Kyle Jones, Thompsonville, MI (US)

(73) Assignee: Layne Christensen Company, Kansas City, KS (US)

( * ) Notice: Subject to any disclaimer, the term of this patent is extended or adjusted under 35 U.S.C. 154(b) by 452 days.

(21) Appl. No.: 13/082,837

(22) Filed: Apr. 8, 2011

(65) Prior Publication Data

US 2012/0255782 A1 Oct. 11, 2012

(51) Int. Cl.
*E21B 7/24* (2006.01)

(52) U.S. Cl.
CPC ..... *E21B 7/24* (2013.01)
USPC ..... 175/55; 175/56

(58) Field of Classification Search
CPC ..... E21B 7/24; E21B 43/003; E21B 28/00
See application file for complete search history.

(56) References Cited

U.S. PATENT DOCUMENTS

| | | | | |
|---|---|---|---|---|
| 1,763,146 | A | 6/1930 | Goowin | |
| 2,743,585 | A | 5/1956 | Berthet et al. | |
| 3,189,106 | A | 6/1965 | Bodine, Jr. | |
| 3,190,369 | A | 6/1965 | Pyles | |
| 3,217,551 | A | 11/1965 | Bodine, Jr. | |
| 3,467,207 | A | 9/1969 | Pyles et al. | |
| 3,684,037 | A | 8/1972 | Bodine | |
| 3,786,874 | A | 1/1974 | Jodet et al. | |
| 4,023,628 | A | 5/1977 | Bodine | |
| 4,217,753 | A | 8/1980 | Loretan | |
| 4,403,665 | A | 9/1983 | Bodine | |
| 4,662,459 | A | 5/1987 | Bodine | |
| 4,693,325 | A | 9/1987 | Bodine | |
| 4,809,790 | A | 3/1989 | Manchak, Jr. | |
| 4,815,328 | A * | 3/1989 | Bodine | 74/87 |
| 5,027,908 | A | 7/1991 | Roussy | |
| 5,086,854 | A | 2/1992 | Roussy | |
| 5,409,070 | A | 4/1995 | Roussy | |
| 5,417,290 | A | 5/1995 | Barrow | |
| 5,540,295 | A | 7/1996 | Serrette | |
| 5,549,170 | A | 8/1996 | Barrow | |
| 5,562,169 | A | 10/1996 | Barrow | |
| 5,812,068 | A | 9/1998 | Wisler et al. | |
| 6,739,410 | B2 | 5/2004 | Smith et al. | |
| 2008/0110673 | A1 * | 5/2008 | Giroux et al. | 175/5 |

(Continued)

OTHER PUBLICATIONS

Mutually-opposed springs, undated, p. 15.

(Continued)

*Primary Examiner* — Jennifer H Gay
*Assistant Examiner* — Caroline Butcher
(74) *Attorney, Agent, or Firm* — Husch Blackwell LLP

(57) ABSTRACT

A sonic drill head comprising an outer housing, an isolation system, a sine generator and a spindle. The sine generator generates a linear sinusoidal vibration force through the rotation of a plurality of eccentric masses. The sine generator is configured to translate the linear sinusoidal force to the spindle in a direction corresponding to the spindle's axis of rotation. The sine generator supports the spindle within the housing such that the spindle is free to rotate about the spindle axis. The spindle is generally a hollow tube section thereby allowing the passage of drilling fluid, mud, cuttings, and/or tooling. The isolation system generally reduces the transfer of the vibration force generated by the sine generator to the outer housing, yet is able to transfer an applied thrust force from the outer housing to the sine generator.

8 Claims, 9 Drawing Sheets

(56) References Cited

U.S. PATENT DOCUMENTS

| | | | | |
|---|---|---|---|---|
| 2009/0173542 | A1* | 7/2009 | Ibrahim et al. | 175/55 |
| 2010/0089646 | A1* | 4/2010 | Drivdahl et al. | 175/55 |
| 2010/0139985 | A1* | 6/2010 | Kejr et al. | 175/189 |

OTHER PUBLICATIONS

Boart Longyear Company, Environmental Drilling Division, Sonic Drilling, undated, 12 pages.
Industry in Action . . . Sonic Drilling Ltd., undated, 2 pages.
Mechanisms simplify timing between shafts, undated, 2 pages.
David O. Smallwood, Chapter 25 Vibration Testing Machines,Shock and Vibration Handbook, undated, 4th Edition, 5 pages.
ResonantSonic(SM) Drilling, Innovative Technology Summary Report, Apr. 1995, 25 pages, U.S. Department of Energy.
Disc Springs, undated, 1 page.
General Fundamentals, undated, 7 pages.
Design Procedures for Dynamically Loaded Foundations, Chapter 10, undated, pp. 336-337.

* cited by examiner

SONIC DRILL HEAD

CROSS-REFERENCE TO RELATED APPLICATIONS

None.

BACKGROUND OF THE INVENTION

The present invention is generally directed to a sonic drill head. Sonic drill heads generally impart a vibratory force and send high frequency resonant vibrations down a drill string to a drill bit. The sonic drill head combines this vibratory force with a slow rotation of the drill string to ensure that the energy applied and wear resulting from drilling are evenly distributed at the drill face. Vibration generators for sonic drilling may be housed with a rotary drive or may be a stand alone component of a drill string. The frequency of vibration is generally between 50 and 120 hertz (cycles per second) and the drill operator controls the frequency of the vibrations to match the natural frequency of the drill string to take advantage of the resonance effects of the drill string and/or to suit the specific conditions of the soil/rock geology. The resonance created at the selected frequency magnifies the amplitude of the drill bit thereby allowing for fast and easy penetration through many geological formations.

Since sonic drilling obtains its results through the combination of resonant vibrations superimposed upon a slow drill rotation, sonic drill heads are generally designed and constructed with no consideration of operating the drill with a high-speed spindle rotation suitable for traditional diamond core drilling or other rotary drilling methods. Sonic drill heads known in the art do not efficiently provide the ability to rotate the spindle at high speeds without vibration such that the drill head can additionally perform traditional diamond core or other rotary drilling methods. Further, either the vibration generator or the rotation drive of existing sonic drill heads is often located directly above the spindle within the drill head that receives the drill string. In one existing drill head, the vibration generator or rotation drive is directly above the spindle thereby preventing the passage of water, drilling fluids, mud, cuttings and/or tooling, or any other materials through the top spindle to or from the drill string and drill head. Other existing drill heads have been adapted to provide a narrow passageway to facilitate the injection of water or drilling fluid to aid in drilling. The passage of materials through the spindle to or from the drill string is generally not a consideration in sonic drill heads currently in use because the slow rotation of sonic drilling does not generally generate the same drilling conditions of other higher speed rotary drilling methods that often require passage of materials through the drill string to aid in the drilling process. As a result, existing sonic drill heads do not currently allow the passage of cuttings through the top of the drill head that are desirable when performing deep drilling. Further, existing sonic drill heads do not currently allow the passage of downhole instrumentation, and/or tooling through the top of the drill head which may be desirable when monitoring downhole conditions while drilling.

Therefore, a need exists in the art for a sonic drill head that allows an operator to perform both sonic drilling—slow rotary motion superimposed to the vibratory motion—and high speed rotary drilling. Accordingly, an additional need exists for a sonic drill head that allows the passage of drilling fluids, mud, cuttings or tooling to be introduced or removed as necessary through the top of the drill head.

BRIEF SUMMARY OF THE INVENTION

The present invention is generally directed to a sonic drill head comprising an outer housing, an isolation system, a sine generator and a spindle. The isolation system is within the housing and generally reduces the transfer of the vibration force generated by the sine generator to the outer housing, yet is able to transfer an applied thrust force from the outer housing to the sine generator. The sine generator is also within the housing and generates a linear sinusoidal vibration force through the rotation of a plurality of rotors, each rotor having an eccentric center of mass. The rotors are driven by meshing bevel gears and, as a result, adjacent rotors rotate in opposite directions. In one embodiment, the eccentric weights are synchronized such that the eccentric masses reach top-dead-center and bottom-dead-center simultaneously creating a linear sinusoidal force. Further, any horizontal components of force generated by the rotation of the eccentric masses generally cancel out because the rotors rotate in opposite directions thereby resulting in a purely linear vertical force generation. The sine generator is configured to translate this linear sinusoidal force and/or the thrust force to the spindle. The direction of force generally corresponds to the spindle's axis of rotation.

The sine generator is configured to support the spindle within the housing such that the spindle is free to rotate about the spindle axis relative to the sine generator, yet the sine generator still transfers the linear sinusoidal force to the spindle along the spindle's axis of rotation. The sine generator is configured to allow the spindle to pass through the sine generator and the spindle may protrude outside the outer housing in some embodiments. This configuration allows the spindle to rotate both at low speeds used for sonic drilling and high speeds used for diamond core or other rotary drill methods. Further, an embodiment of the present invention includes the spindle being a continuous and hollow tube section allowing the introduction or removal of drilling fluid, mud, cuttings, and/or tooling, or other drilling aids into or out of the drill string through the top of the spindle.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawing forms a part of the specification and is to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 1:
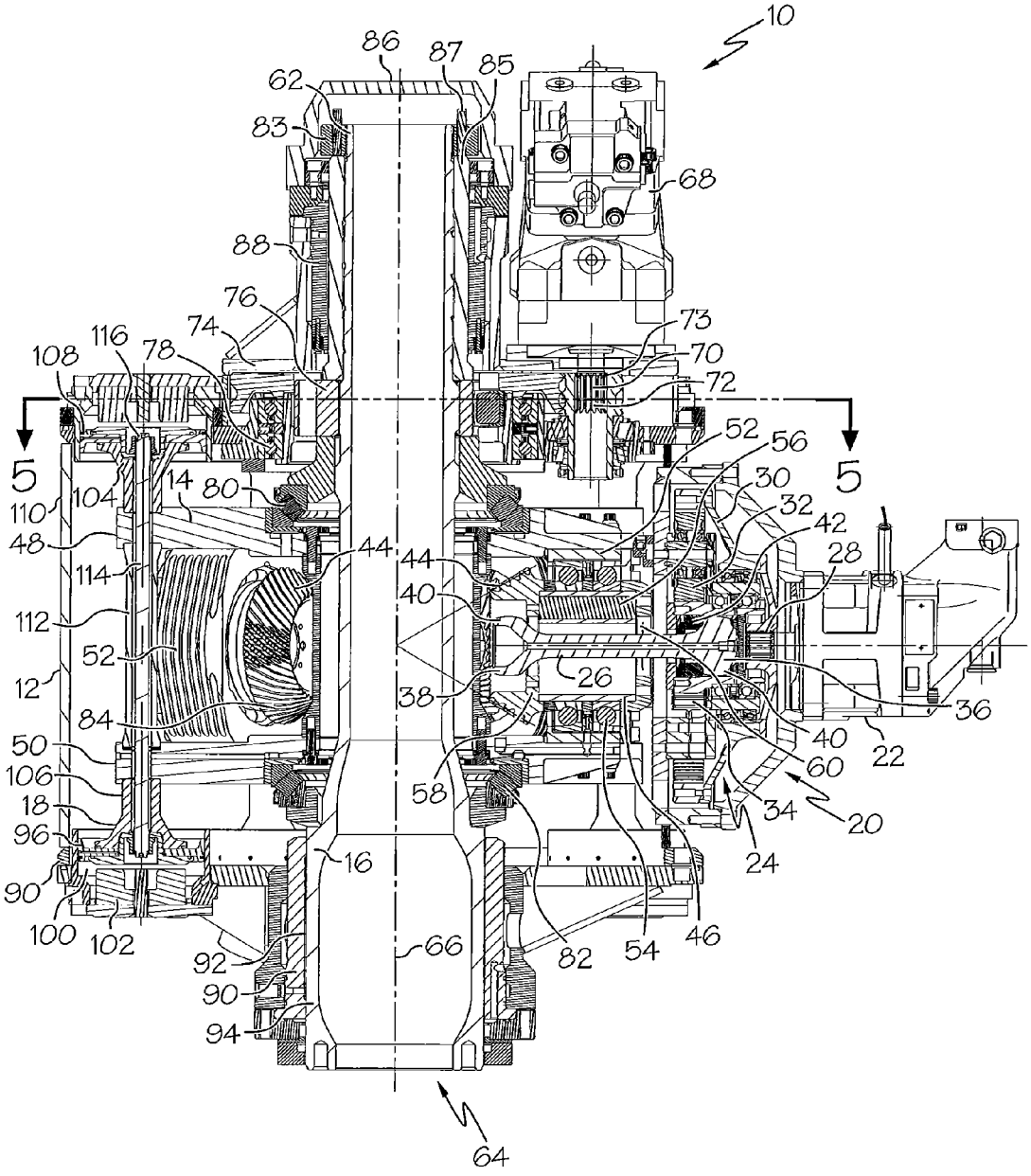
FIG. 1 is a cross-sectional view of a sonic drill head in accordance with one embodiment of the present invention.

Now turning to FIG. 1, a sonic drill head 10 comprises an outer housing 12, a sine generator 14, a spindle 16, and an isolation system 18. Outer housing 12 generally encloses the other components of sonic drill head 10 including sine generator 14, spindle 16 and isolation system 18. An embodiment of outer housing 12 may be assembled such that the entire outer housing 12 or a portion thereof maybe removed to allow access to sine generator 14, spindle 16, or isolation system 18 for upkeep, replacement, repair, other maintenance or any other reason required in the art. Outer housing 12 can be a single cast or molded piece or, alternatively, a plurality of component pieces coupled together to enclose sine generator 14, spindle 16 and isolation system 18. Outer housing 12 of the present invention can be made from any material known in the art including steel, iron, titanium, aluminum, industrial plastics, fiber glass, carbon-fiber composite, any other industrial material having the required strength properties, or any combination thereof.

Sine generator 14 is driven by a vibration drive system 20 and comprises a motor 22, a gearing system 24, and drive shaft 26. Motor 22 includes an output shaft 28. Motor 22 can be any motor type known in the art including hydraulic, pneumatic, electric, gas turbine engine, or an internal combustion engine. Output shaft 28 removably and drivingly engages gearing system 24 described in detail below. Gearing system 24 is configured to drivingly engage drive shaft 26 and increase the speed of rotation of drive shaft 26 when compared to the rotation speed of output shaft 28. One embodiment of gearing system 24 is a planetary gearing system comprising a ring gear 30, a plurality of planetary gears 32, and a sun gear 34. Gearing system 24 can be configured to any speed increasing ratio known in the art as necessary to obtain the desired vibration force and frequency. An embodiment of gearing system of the present invention can incorporate a speed increasing ratio in the range between one and one-half to one (1½:1) and six to one (6:1). An embodiment of gearing system 24 of the present invention incorporates a speed increasing ratio around three to one (3:1).

FIG. 1. illustrates an embodiment of drive shaft 26 having a first end 36 and a second end 38 wherein first end 36 and second end 38 of drive shaft 26 include crowned splines 40. The crowned splines 40 of first end 36 of drive shaft 26 allow for engagement with mating splines contained in sun gear 34. First end 36 of drive shaft 26 is retained in sun gear 34 through a pair of spring loaded spherical bearings 42. The crowned splines 40 of second end 38 of drive shaft 26 allow for mating engagement with splines contained in a bevel gear 44 coupled to an eccentric rotor 46 of sine generator 14. The crowned splines 40 allow drive shaft 26 to transmit power from sun gear 34 to bevel gear 44 while bevel gear 44 and eccentric rotor 46 are vibrating with sine generator 14.

Sine generator 14 generally comprises a top plate 48, a bottom plate 50, and a plurality of eccentric rotors 46, each rotor 46 within a rotor housing 52. Each rotor housing 52 is positioned between top plate 48 and bottom plate 50. Rotor housing 52 is generally coupled to top plate 48 and bottom plate 50. Eccentric rotor 46 is journaled for rotation within rotor housing 52 upon rotor bearings 54. Eccentric rotor 46 has an eccentric mass 56 that offsets the center of mass of eccentric rotor 46 from the center of rotation of eccentric rotor 46 by a selected amount. Eccentric rotor 46 further includes an inside face 58 and an outside face 60. Bevel gear 44 is coupled to the inside face 58 of eccentric rotor 46 using any method known in the art. Through out this description, the term "coupling" shall be interpreted to include all coupling methods known in the art including, but not limited to: bolts, screws, pins, rivets, welds, retention rings, compression rings, or any other mechanical coupling method known in the art. Alternatively, bevel gear 44 may be cast with eccentric rotor 46 as one component piece.

Sine generator 14 and its components described above can be of any material known in the art including steel, iron, titanium, aluminum, industrial plastics, fiber glass, carbon-fiber composite, any other industrial material having the required strength properties, or any combination thereof.

Spindle 16 includes a first end 62 and a second end 64. First end 62 and second end 64 generally define spindle axis 66. Spindle 16 is rotated about spindle axis 66 during drilling operations. Spindle 16 is driven by at least one spindle motor 68. An output shaft 70 of spindle motor 68 operably engages a pinion gear 72. In one embodiment, output shaft 70 is splined and pinion gear 72 includes a mating splined inner face 73 to align with and receive output shaft 70. Any other mechanical coupling methods known in the art, including those described above, may be instituted such that output shaft 70 drivingly engages pinion gear 72. Pinion gear 72 engages rotation gear 74 that transfers the torque generated by spindle motor 68 to spindle 16 through torque transfer assembly 76 thereby causing rotation of spindle 16 about spindle axis 66. An embodiment of the present invention includes two spindle motors 68, each spindle motor 68 driving a pinion gear 72 that is drivingly engaged with rotation gear 74. Rotation gear 74 and torque transfer assembly 76 are journaled for rotation relative to outer housing 12 upon rotation drive bearings 78. Rotation drive bearings 78 are generally roller bearings, but can be any bearing type or configuration known in the art that facilitates the rotation of spindle 16 with respect to outer housing 12.

Spindle 16 is mounted to sine generator 14 with upper spindle bearing 80 and lower spindle bearing 82. Spindle bearings 80, 82 allow independent rotary motion of spindle 16 with respect to a center 84 of sine generator 14. Spindle bearings 80, 82 also the transfer the vibration force from sine generator 14 to spindle 16. The spindle bearing configuration of the present invention allows sonic drill head 10 to be utilized for sonic drilling—the superposition of slow rotation with vibration upon spindle 16—and traditional high speed rotary drilling including, but not limited to diamond core, and other rotary drill methods known in the art. One embodiment of the present invention includes spindle bearings 80, 82 being spherical roller thrust bearings. Any other bearing type or configuration known in the art that supports spindle 16 upon sine generator 14 while allowing for free rotation of spindle 16 with respect to sine generator 14 and also transferring the vibratory force from sine generator 14 to spindle 16 is within the scope of the present invention. In one embodiment of the present invention, the spindle bearing preload is adjusted by means of a spindle lock nut 83 and thrust sleeve 85. The nut contains jack screws 87 that each individually contribute to the entire developed preload, thereby eliminating the need to torque the spindle lock nut 83. Tightening of the jack screws 87 creates an upward acting force on spindle 16 and an equal and opposite downward acting force on the thrust sleeve 85 and associated components which places upper and lower spindle bearings 80, 82 into compression, or preload, against sine generator 14.

Spindle 16 generally is a continuous member having a hollow cross section as shown in FIG. 1. Spindle 16 is a member generally having circular cross-section; however, any member shape in the art known to be used as a spindle 16 may be used. One embodiment of spindle 16 includes a one piece hollow shaft. An alternative embodiment of spindle 16 may include a plurality of members coupled together having an uninterrupted hollow cross-section. An embodiment of the present invention may include spindle 16 having a solid cross-section. An embodiment of spindle 16 includes first end 62 and second end 64 of spindle 16 protruding through the outer housing 12. Embodiments of the present invention may include spindle 16 protruding out of the top or the bottom of the outer housing, or both. The continuous hollow cross section of spindle 16 is configured for the addition or removal of cuttings, materials, lubricants, tools, instrumentation, or other drilling aids.

Common materials that may be introduced into drilling string through first end 62 of spindle 16 may include drilling fluid, mud, and tooling (not shown). In addition, materials including drilling fluid, mud, tools, or cuttings resulting from the drilling process may be removed through the first end 62 of spindle 16. It will be appreciated by one of skill in the art that any of a number of materials, tools, or other drilling aids may be introduced into or removed from the drill string through first end 62 of spindle 16. When no materials, tools or drilling aids are to be removed or introduced through first end 62 of spindle 16, an embodiment of the present invention may include a cap 86 removably coupled to first end 62 of spindle 16 or to outer housing 12 as shown.

The second end 64 of spindle 16 can be configured to receive a drill string (not shown). Any drill string known in the art for sonic drilling, diamond core drilling, rotary drilling, or any other drilling method known in the art suitable for use with sonic drill head 10 is within the scope of the present invention. There are many connection types known in the art to removingly couple a drill string to second end 64 of spindle 16, all of which a person of skill in the art would appreciate to be within the scope of the present invention.

Spindle 16 is generally journaled for rotation and axial movement with respect to outer housing 12 of sonic drill head 10. One embodiment of the present invention includes first end 62 and second end 64 journaled through an upper hydrostatic bearing 88 proximate first end 62 of spindle 16 and a lower hydrostatic bearing 90 proximate second end 64 of spindle 16. The hydrostatic bearings 88, 90 float spindle 16 on a thin film of oil that is pumped in under pressure. Hydrostatic bearings 88, 90 contain a plurality of inner pockets (not shown) that are fed with supply oil through a metering orifice. In one embodiment, a clearance gap 92 between the spindle journal 94 and the bearing inner diameter (not shown) is maintained to restrict oil leakage and prevent reduced bearing capacity. Hydrostatic bearings 88, 90 have a low coefficient of friction and virtually unlimited wear life. An alternate embodiment (not shown) includes using commercially available non-hydrostatic slide bearings comprising a steel base layer, a bronze mid-layer and a low-friction polymer top-layer. This slide bearing may or may not be lubricated. A person of skill in the art will appreciate that the present invention is not limited to use of hydrostatic bearings to facilitate rotation and axial translation of spindle 16 with respect to outer housing 12 as described herein, but any traditional sliding bearing that facilitates this relative movement now known or hereafter developed is within the scope of the present invention.

Spindle 16 and its components described above can be of any material known in the art including steel, iron, titanium, aluminum, industrial plastics, fiber glass, carbon-fiber composite, any other industrial material having the required strength properties, or any combination thereof.

FIG. 1 further illustrates an embodiment of isolation system 18. Isolation system 18 generally isolates the high amplitude vibratory motion of spindle 16 from outer housing 12 wherein outer housing 12 remains relatively stationary. An embodiment of the isolation system 18 of the present invention includes a plurality of assemblies comprising an air piston 96 and a cylinder 98 that provide separation of the stationary and moving parts with a cushion of compressed air 100. An embodiment of the present invention includes twelve (12) air piston 96 and cylinder 98 assemblies. Embodiments of isolation system 18 of the present invention can alternatively include, but are not limited to: mechanical springs or shocks, air springs or shocks, hydraulic springs or shocks, fluid dampers, passive or active mass dampers, or any other system known in the art to isolate the vibration generated by sine generator 14 from outer housing 12.

An embodiment of the present invention may also include an isolation system 18 and sine generator 14 that translates a thrust force during drilling from the outer housing 12 to spindle 16. An embodiment of the present invention includes piston 96 and cylinder 98 assemblies translating thrust forces from the outer case to the drill spindle during drilling. Properly sized and placed inlet and exhaust porting (not shown) within cylinders 98 cause sine generator 14 to seek a centered position within outer housing 12 when acted upon by external forces. An embodiment of isolation system 18 may also include a bumper 102 to limit the motion of sine generator 14 to reduce or prevent damage to outer housing 12 or piston 96 in the event of a force overload. Bumper 102 can be any configuration and material known in the art to reduce or prevent damage during the impact of two members. Embodiments of bumper 102 may include mechanical springs or elastomeric pads.

An embodiment of isolation system 18 further includes an upper piston assembly 104 proximate top plate 48 of sine generator 14 and a lower piston assembly 106 proximate bottom plate 50 of sine generator 14 wherein upper piston assembly 104 and lower piston assembly 106 are aligned. Upper piston assembly 104 and lower piston assembly 106 further include a sealing member 108 that engages a wall 110 of cylinder 98 to form a substantially air tight seal. Sealing member 108 can be any material having a resiliency to withstand many cycles of vibratory motion relative wall 100 of cylinder 98 and maintain a substantially air-tight seal including, but not limited to: cast iron, aluminum, steel, brass, rubber, polymeric composite blends, fiber-reinforced composites, and elastomeric materials. An embodiment uses a cast iron sealing member 108.

Figure 2:
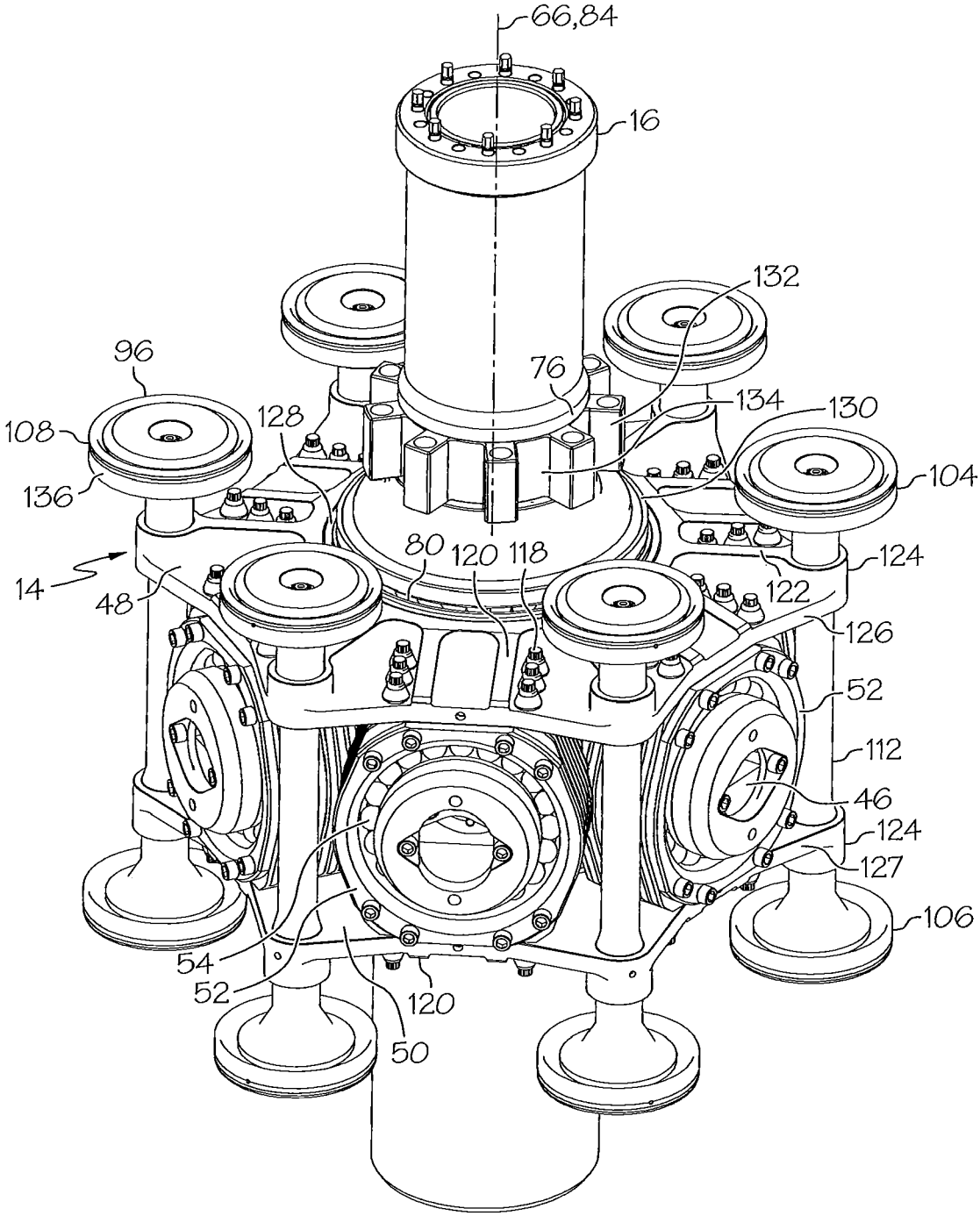
FIG. 2 is a front perspective view of a sine generator and isolation system in accordance with one embodiment of the present invention.

Isolation system 18 may further include a spacer 112 between top plate 48 and bottom plate 50 of sine generator 14 and a threaded rod 114 through apertures (not shown) in upper piston assembly 104, top plate 48, spacer 112, bottom plate 50, and lower piston assembly 106 as shown in FIG. 2. The present invention is not limited to a threaded rod, but any smooth rod having threading at each end may be used. Further, a nut 116 engages each end of threaded rod 114 and is tightened thereby clamping upper piston assembly 104, top plate 48, spacer 112, bottom plate 50, and lower piston assembly 106 into a substantially rigid assembly. This assembly must transfer force axially in the direction of vibration. Alternatively, any other method of assembling upper piston 104, top plate 48, spacer 112, bottom plate 50, and lower piston 106 such that they form a substantially rigid member capable of transferring force in the direction of vibration is within the scope of the present invention, including threading components such that they matingly engage with the other components as required or welding components together.

Isolation system 18 and its components described above can be of any material known in the art including steel, iron, titanium, aluminum, industrial plastics, fiber glass, carbon-fiber composite, any other industrial material having the required strength properties, or any combination thereof.

Now turning to FIG. 2, one embodiment of sine generator 14, spindle 16 and isolation system 18 is further illustrated. This embodiment includes six rotors 46, each rotor 46 journaled for rotation in a rotor housing 52. A plurality of rotor bearings 54 facilitates the rotation of rotor 46 within rotor housing 52. One embodiment of the present invention includes rotor bearings 54 being angular contact rolling element bearings mounted in a back to back arrangement. A person of skill in the art will appreciate that the present invention is not limited to a particular rotor bearing type, but any known bearing types in the art are within the scope of the present invention. In one embodiment, rotor housing 52 is coupled to both top plate 48 and bottom plate 50 of sine generator 14 with six bolts 118 at each plate 48, 50 as shown. The coupling of rotor housing 52 to both plates 48, 50 of sine generator 14 shall not be limited to a bolted connection, but can be any coupling method known in the art using any number of fasteners including: bolts, screws, pins, rivets, welds, retention rings, compression rings, clamps, or any other mechanical coupling method known in the art.

FIG. 2 also demonstrates an embodiment of top plate 48 and bottom plate 50 that further includes two stiffener ribs 120 proximate each coupling position of housing 52. Ribs 120 generally stiffen plates 48, 50 at or near where rotor housing 52 applies the vibration force to plates 48, 50. Further, an embodiment of top plate 48 and bottom plate 50 includes a stiffener 122 proximate a piston housing 124 that receives upper piston 104 in top plate 48 and lower piston 106 in bottom plate 50 wherein piston housing 124 is proximate an outside face 126 of top plates 48 or proximate an outside face 127 of bottom plate 50. Ribs 120 generally extend from outer face 126 or 127 to an inner face 128 of sine generator 14 and are integral with top plate 48 or bottom plate 50. Stiffeners 122 generally extend from piston housing 124 to inner face 128 in a radial direction from center 84 of sine generator 14 on either plate 48, 50. Embodiments of the present invention may include center 84 being located on spindle axis 66 of spindle 16 as shown.

FIG. 2 illustrates an embodiment of the present invention wherein the six rotors 46 are in a hexagonal shape, extending radially from spindle axis 66. The layout of rotors 46 forms an aperture (not shown) that generally corresponds with inner face 128 of sine generator 14. This configuration of sine generator 14 allows spindle 16 to be a continuous member that extends through sine generator 14 as shown. FIG. 2 also illustrates the location of upper spindle bearing 80 with respect to top plate 48. One embodiment of the present invention includes upper and lower spindle bearings 80, 82 being a spherical thrust bearing assembly. One embodiment includes spindle bearings 80, 82 having a cage 130 made of light weight polymer. The lightweight polymer helps to eliminate damage caused by inertial effects. An alternative embodiment includes cage 130 being made from lightweight, high strength steel. Further, the geometry of the cage is modified to minimize axial clearance with respect to the bearing elements, thereby reducing the impact forces cause by the high level of vibration.

FIG. 2 further illustrates an embodiment of torque transfer assembly 76 that includes a plurality of lobes 132 wherein the lobes 132 are coupled to or integral with a continuous ring 134. Other members of torque transfer assembly (not shown) drivingly engage lobes 132 causing the lobes 132 and continuous ring 134 to rotate about spindle axis 66. Continuous ring 134 is configured to engage spindle 16 such that torque applied to continuous ring 134 causes the rotation of spindle 16 about spindle axis 66.

FIG. 2 further illustrates an embodiment of isolation system 18 of the present invention. In the illustrated embodiment, upper piston 104 is received into piston housing 124 of top plate 48 and lower piston 106 is received into piston housing 124 of bottom plate 50. Further, spacer 112 is located between top plate 48 and bottom plate 50. One embodiment includes spacer 112 being received into a recess in the surface of top and bottom plates 48, 50 configured receive spacer 112. One embodiment includes spacer 112 bearing directly on top and bottom plates 48, 50. FIG. 2 also further illustrates sealing member 108 on an outside face 136 of piston 96.

Figure 3:
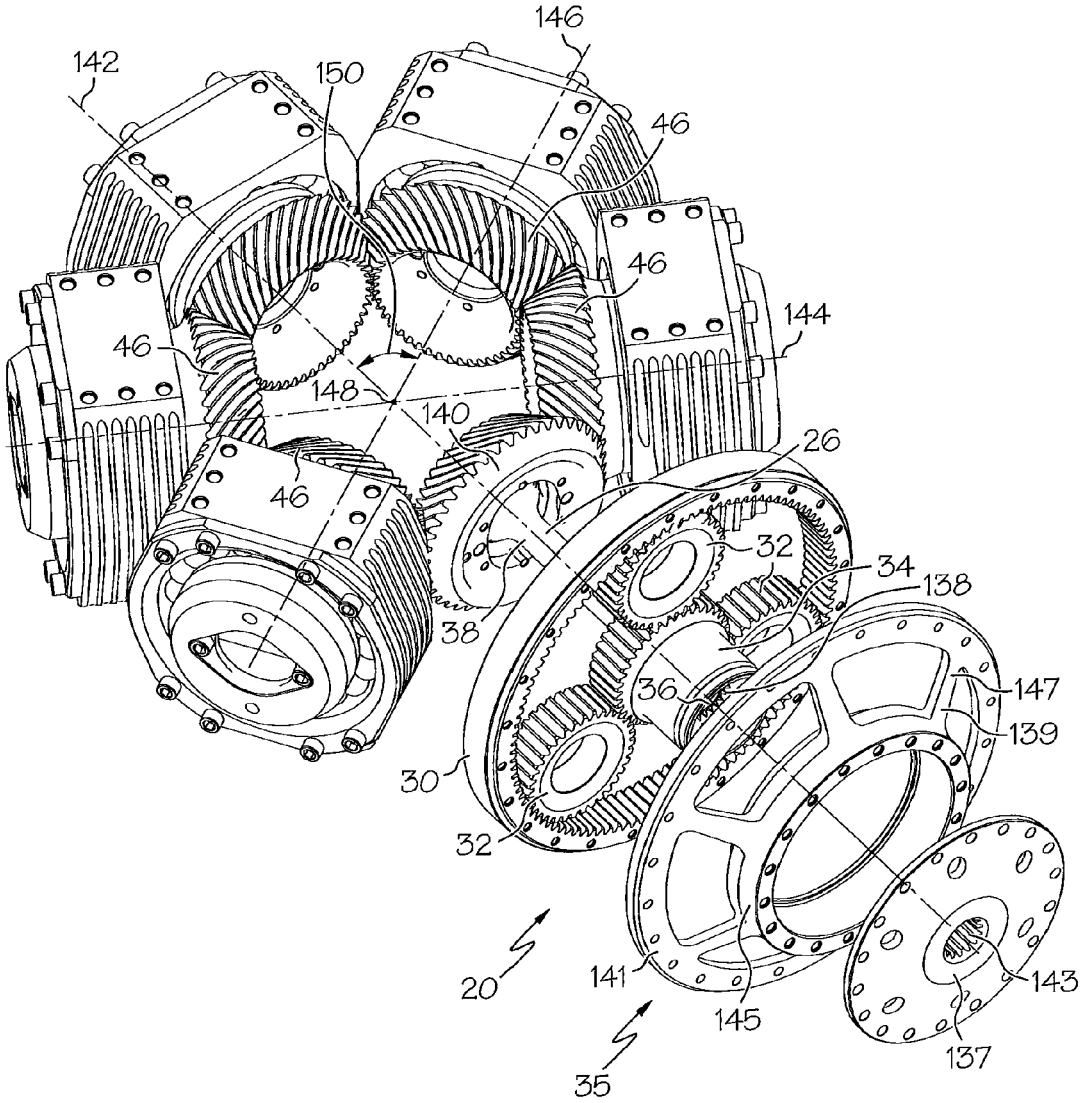
FIG. 3 is a top perspective view of the rotors and vibration drive system in accordance with one embodiment of the present invention.

Now turning to FIG. 3, components of vibration drive system 20, gearing system 26 and the configuration of eccentric rotors 46 of one embodiment of the present invention are illustrated. FIG. 3 illustrates gearing system 26 including a ring gear 30, three planet gears 32, a sun gear 34, and a ring gear drive assembly 135 wherein ring gear drive assembly 135 further comprises input housing 137, radial arms 139, and attachment ring 141. Motor 22 turns output shaft 28 that provides input torque to ring gear assembly 30. Output shaft 28 includes radial extending teeth or splines that matingly engage teeth or splines on an inner face 143 of input housing 137 of ring gear assembly 135. The present invention may include embodiments wherein input housing 137, radial arms 139 and attachment ring 141 of ring gear assembly 135 are stand alone parts coupled together, integrally cast into one part, or any combination thereof. A first end 145 of radial aims 139 are rigidly coupled to or cast integral proximate housing 137 and radial arms 139 extend radially from housing 137 wherein a second end 147 of radial arms 139 is proximate attachment ring 141. Radial arm 139 may be one piece or a plurality of components coupled together. An embodiment of the present invention may alternatively use a substantially solid formed plate instead of the radial arms 139 to transfer torque from input housing 137 to attachment ring 141. Attachment ring 141 is generally coupled to or cast integral with ring gear 30. Ring gear 30 is drivingly engaged with three planetary gears 32. The axis of rotation for each planetary gear 32 is held static and the planetary gears 32 drivingly engage sun gear 34 and create output torque that rotates sun gear 34.

Sun gear 34 engages and thereby causes the rotation of drive shaft 26. First end 36 of drive shaft 26 may have crowned splines 40 that removably engage with mating splines 138 of sun gear 34. Second end 38 of drive shaft 26 engages with a driven bevel gear 140. Driven bevel gear 140 drivingly engages two adjacent bevel gears 44. FIG. 3 illustrates an embodiment of the present invention wherein the six bevel gears 44, 140, eccentric rotors 46, and housings 52 are configured in a hexagonal distribution around the center 84 of sine generator 14. This embodiment further includes each bevel gear 44 being paired with an opposite bevel gear 44, resulting in three pairs of bevel gears. Each pair of bevel gears 44 is aligned along a first pair line 142, a second pair line 144, and a third pair line 146. One embodiment of the present invention includes the pair lines 142, 144, 146 intersecting at a common point 148. An embodiment of the present invention includes lines 142, 144, 146 all including an intersecting angle 150 of sixty (60) degrees. Other intersecting angles are also within the scope of the present invention. An embodiment of the present invention includes common point 148 being on spindle axis 66.

In general, the six bevel gears 44 operate in series; therefore, rotating driven bevel gear 140 causes the rotation of all the other bevel gears. Each bevel gear 44, 140 are integral with or coupled to an eccentric rotor 46 within rotor housing 52 and the rotation of each bevel gear 44 causes the rotation of each rotor 46. An embodiment of bevel gear 44 includes spiral bevel gear although a person of skill in the art will appreciate any of a number of bevel gear types and configurations known in the art are within the scope of the present invention.

Figure 4:
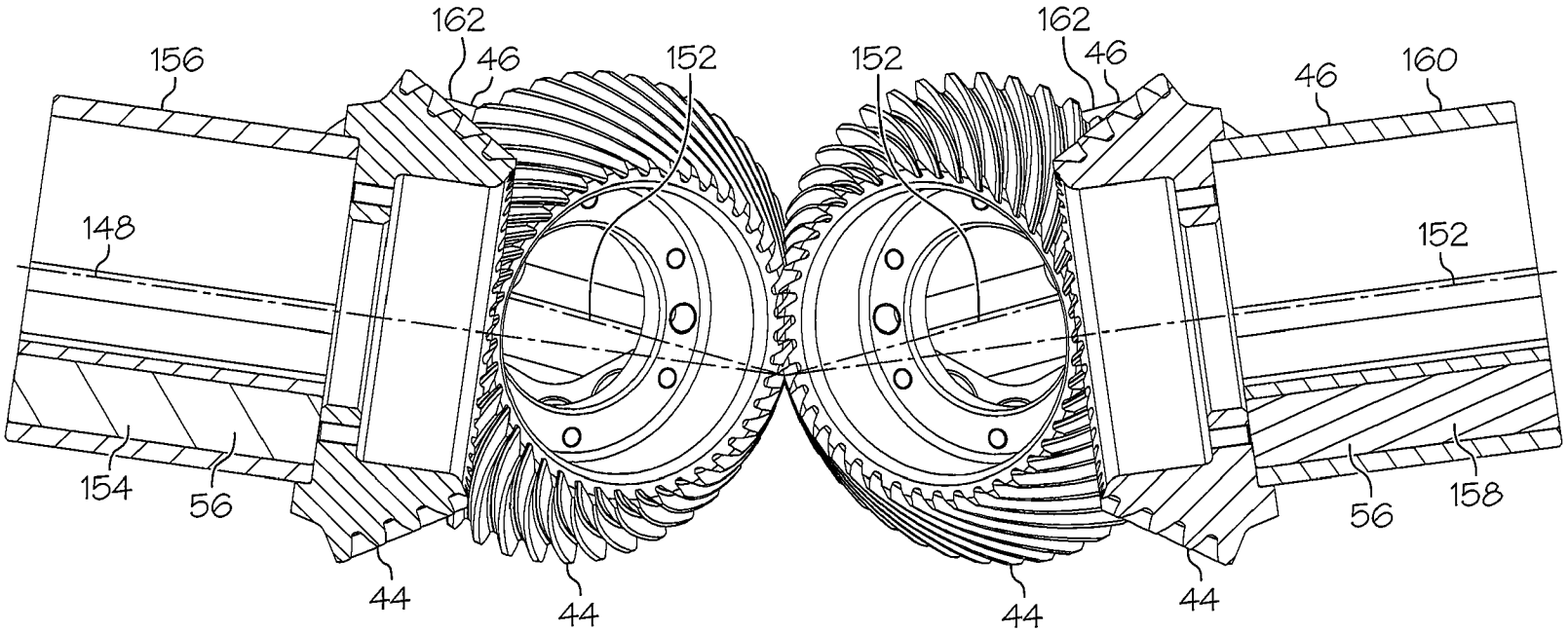
FIG. 4 is a cross-sectional view of the rotors in accordance with one embodiment of the present invention.

FIG. 4 illustrates an embodiment of sine generator 14 of sonic drill head 10 wherein eccentric rotor 46 axis of rotation 152 is tilted from horizontal. This embodiment results in all six rotors 46 having an individual axis of rotation 148. FIG. 4 further illustrates an embodiment of the sine generator 14 of the present invention wherein rotors 46 are synchronized with bevel gears 44 such that all eccentric masses 56 reach top-dead-center and bottom-dead-center simultaneously. Specifically, it can be seen in FIG. 4 that a first eccentric mass 154 of a first rotor 156 and a second eccentric mass 158 of a second rotor 160 are both at bottom-dead-center. In this embodiment, the other eccentric masses 56 of the other two rotors 162 shown in FIG. 4 and the two rotors not shown are also at bottom-dead-center. When the eccentric masses 56 of all rotors 46 are synchronized and rotate about their individual axis of rotation 152, the forces in the top-dead-center direction and bottom-dead-center direction are additive creating a linear sinusoidal force in a direction corresponding with top-dead-center and bottom-dead-center. No resultant horizontal force is present because bevel gears 44 cause adjacent rotors 46 to rotate in opposite directions and, as a result, any horizontal force components created by the rotation of eccentric rotors 46 cancel out when an even number of eccentric rotors 46 are present as shown.

Figure 5:
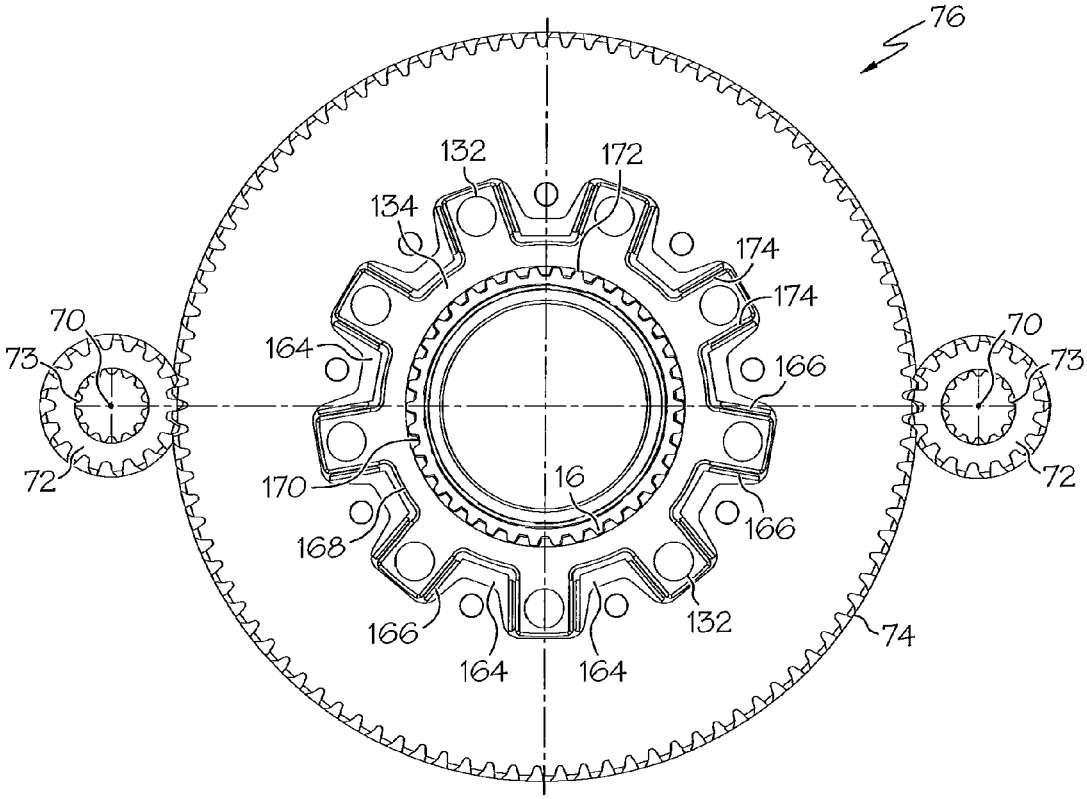
FIG. 5 is a cross-sectional view taken along the line 5-5 of a torque transfer assembly in accordance the embodiment of the present invention in FIG. 1.

Now turning to FIG. 5, an embodiment of torque transfer assembly 76 of sonic drill head 10 is illustrated. Torque transfer assembly 76 generally transfers the drive force generated by at least one spindle motor 68 to spindle 16. FIG. 5 illustrates an embodiment of sonic drill head 10 powered by two spindle motors 68. Output shafts 70 of each spindle motor 68 are shown in FIG. 5 to be splined and engaging a mating splined inside face 73 of pinion gear 72. Pinion gears 72 are drivingly engaged with rotation gear 74. The relative size difference between the pinion gears 72 and rotation gear 74 determines the torque increasing ratio. Embodiments of the present invention include a torque increasing ratio being in the range between one and one-half to one (1½:1) and ten to one (10:1). An embodiment of the present invention may have a torque increasing ratio of generally around five to one (5:1). Spindle motor 68 operates at its highest displacement during sonic drilling providing a low speed output with high torque. Spindle motor 68 may alternatively operate at its minimum displacement to perform diamond core or other known high speed rotary drill methods providing a high speed output with low torque.

Torque is generally transferred from the spindle motor 68, pinion gear 72, and rotation gear 74 to spindle 16 through torque transfer assembly 76 in the present invention. An embodiment of the driving half of torque transfer assembly 76 as shown in FIG. 5 includes a plurality of housings 164 coupled to rotation gear 74 wherein a pair of bearing pads 166 are coupled to each housing 164. One embodiment includes bolting housing 164 to rotation gear 74, but any coupling method known in the art including: bolts, screws, pins, rivets, welds, retention rings, compression rings, or any other mechanical coupling method known in the art is within the scope of the present invention. An embodiment of the driven half of torque transfer assembly 76 as shown includes a plurality of lobes 132 that radiate outward from an outer face 168 of continuous ring 134. Lobes 132 may be evenly spaced around circumference of continuous ring 134 or, alternatively, may be unevenly spaced. Housings 164 are configured on rotation gear 74 to matingly engage lobes 132 whether lobes 132 are evenly or unevenly spaced.

Continuous ring 134 is shown to have a splined inner face 170. Splined inner face 170 of continuous ring 134 mates with splines 172 integral to spindle 16. Splines 172 not only transfer torque, but are configured to allow axial slip of ring 134 and thrust sleeve 85 to effect preload of spindle bearings 80, 82. Each lobe 132 is configured to be located between two housings 164 and bear against a pair of bearing pads 166, yet remain axially translatable with respect to the bearing pad 166 pairs and housings 164. One bearing pad 166 engages with a side 174 of each lobe 132 for the purpose of transferring torque in two directions. The embodiment shown in FIG. 5 includes eighteen (18) bearing pads 166 coupled to nine (9) housings 164 and nine (9) lobes 132 to complete the transfer of torque from the spindle motor(s) 68 to spindle 16.

Figure 6:
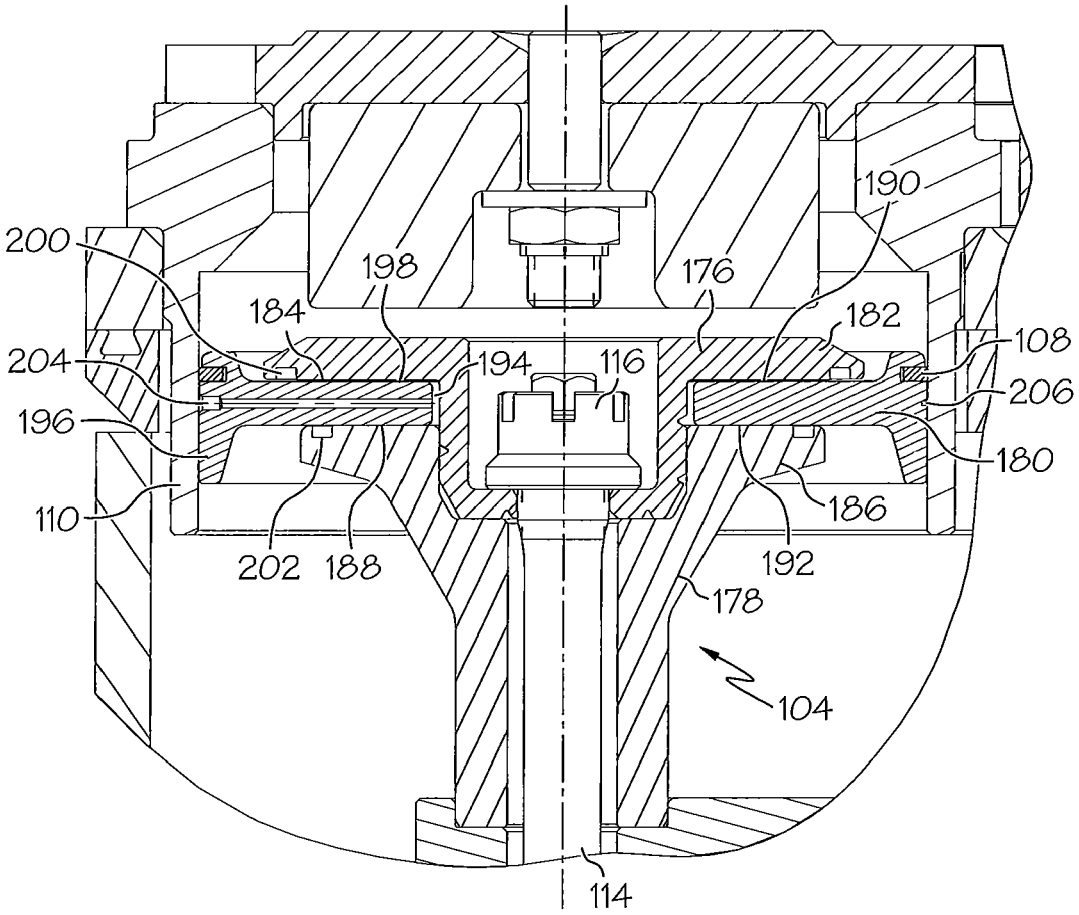
FIG. 6 is a cross-sectional view of the piston assembly in accordance with one embodiment of the present invention.

An embodiment of an upper piston assembly 104 of the present invention is shown in FIG. 6. Lower piston assembly 106 can be constructed in a substantially identical manner. Upper piston assembly 104 as shown includes an upper piston support 176, lower piston support 178, and piston 180. Upper piston support 176 includes an upper support flange 182 having a lower surface 184. Lower piston support 178 includes a lower support flange 186 having an upper surface 188. Piston 180 includes a top surface 190, a bottom surface 192, an inner aperture 194, and outer surface 196. Upper piston support 176 passes through the inner aperture 194 of piston 180 and nests in lower piston support 178 as shown and piston 180 is thereby sandwiched between lower surface 184 of upper piston support 176 and upper surface 188 of lower piston support 178. Upper piston support 176 and lower piston support 178 are configured such that rod 114 passes through both members and upper piston support 176 is coupled to lower piston support 178 and secured thereto by nut 116 as shown.

One embodiment of piston assembly 104, 106 includes a clearance gap 198 between lower surface and a sealing member 108. Clearance gap 198 may be configured to allow a lubricant to be introduced between the piston supports 176, 178 and piston 180. An upper o-ring 200 nests in lower surface 194 of upper piston support 176 and a lower o-ring 202 nests in upper surface 188 of lower piston support 178 as shown wherein o-rings 200, 202 retain the lubricant. Clearance gap 198 allows the upper and lower piston supports 176, 178 to shift relative to piston 180. This embodiment provides the piston 180 interface with cylinder wall 110 to react and resist torsion forces developed in spindle bearings 80, 82. One embodiment includes a clearance gap of 0.010 inches, though any gap providing lubrication and relative slip of piston 180 with upper support 176 and lower support 178 is within the scope of the present invention. In one embodiment of the present invention, isolation system 18 performs at least three functions including, but not limited to vibration isolation, thrust force transfer, and torque resistance.

Outer surface 196 of piston 180 may include sealing member 108 nested into a grove or housing machined into outer surface 196 as shown. Further piston 180 may also include a lubrication metering orifice 204 located in at least one location on outside surface 196 of piston 180. Lubrication metering orifice 204 allows for manual or automated measurement of lubricant level or operating temperature. Outer surface 196 may also include a lubrication groove 206 as shown to lubricate the relative movement between outer surface 196 and cylinder wall 110. Any lubrication method know in the art to lubricate piston 180 for translation relative to cylinder wall 110 may be implemented to supply liquid or dry lubricants to outer surface 196 and the piston assembly 104, 106.

Figure 7:
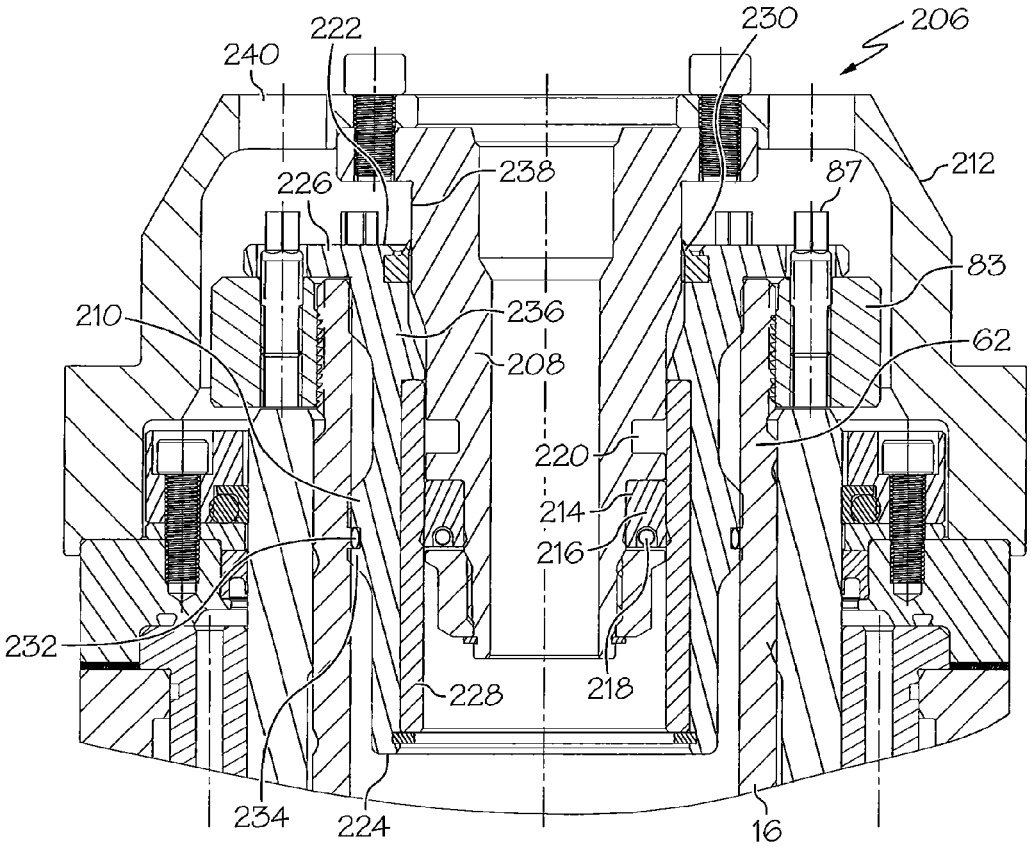
FIG. 7 is a cross-sectional view of a water swivel in accordance with one embodiment of the present invention.

An embodiment of the present invention including water swivel 206 at the first end 62 of spindle 16 is shown in FIG. 7. Water swivel 206 generally includes a stator 208, a rotor 210, and a bonnet 212. Stator 208 is generally configured to be a non-rotating component that facilitates fluid entry into spindle 16 as shown. Stator 208 generally includes a hollow cross-section configured to receive a pressure hose fitting as shown and to facilitate the passage of fluid in or out of stator 208. The shape of stator 208 may be any shape known in the art, including the configuration shown in FIG. 7. Stator 208 may include a housing 214 that receives seal 216, wherein seal 216 may include bearings 218 that facilitate the relative rotation of rotor 210 with respect to stator 208. Stator 208 may also include grease groove 220 as shown.

Rotor 210 is generally attached to and configured to rotate with spindle 16. Rotor 210 may include a first end 222, a second end 224, a flange 226, a polished ceramic liner 228, a wiper 230, and a groove 232 that receives a static o-ring 234. Rotor 210 is generally configured to be received into first end 62 of spindle 16 substantially as shown. One embodiment includes rotor 210 being coupled to spindle lock nut 83 with jack screws 87 wherein spindle lock nut 83 is threaded onto first end 62 of spindle 16.

An embodiment of rotor 210 may include a hollow cross section configured to receive stator 208 as shown. The hollow cross-section also allows fluid to pass through the ends of rotor 210. In this embodiment, static o-ring 234 is configured to provide a fluid-tight seal between the rotor 210 and the spindle 16 to prevent any introduced water from being unwantingly expelled out of first end 62 of spindle 16. Polished ceramic liner 228 is configured to provide a surface that offers reduced friction during the rotation of rotor 210 about stator 208 while in contact with seal 216 of stator 208. An embodiment of rotor 210 may also include wiper 230 generally configured to exclude dirt, dust, or other contaminants from affecting the seal between stator 208 and rotor 210. As shown in FIG. 7, wiper 226 is proximate an inner surface 236 of rotor 210 and rests against an outer surface 238 of stator 208.

An embodiment of the present invention may include bonnet 212 that covers the stator 208 and rotor 210 as shown. Bonnet 212 may be removably coupled to stator 208. Further, bonnet 212 may be removably coupled to outer housing 12. An embodiment of bonnet 212 includes access apertures 240 allowing an operator to rotate jack screws 87 thereby adjusting the pre-load of spindle bearings 80, 82 as described above without removing the bonnet for minimal interruption of the operation of the sonic drill head 10 of the present invention.

Figure 8A:
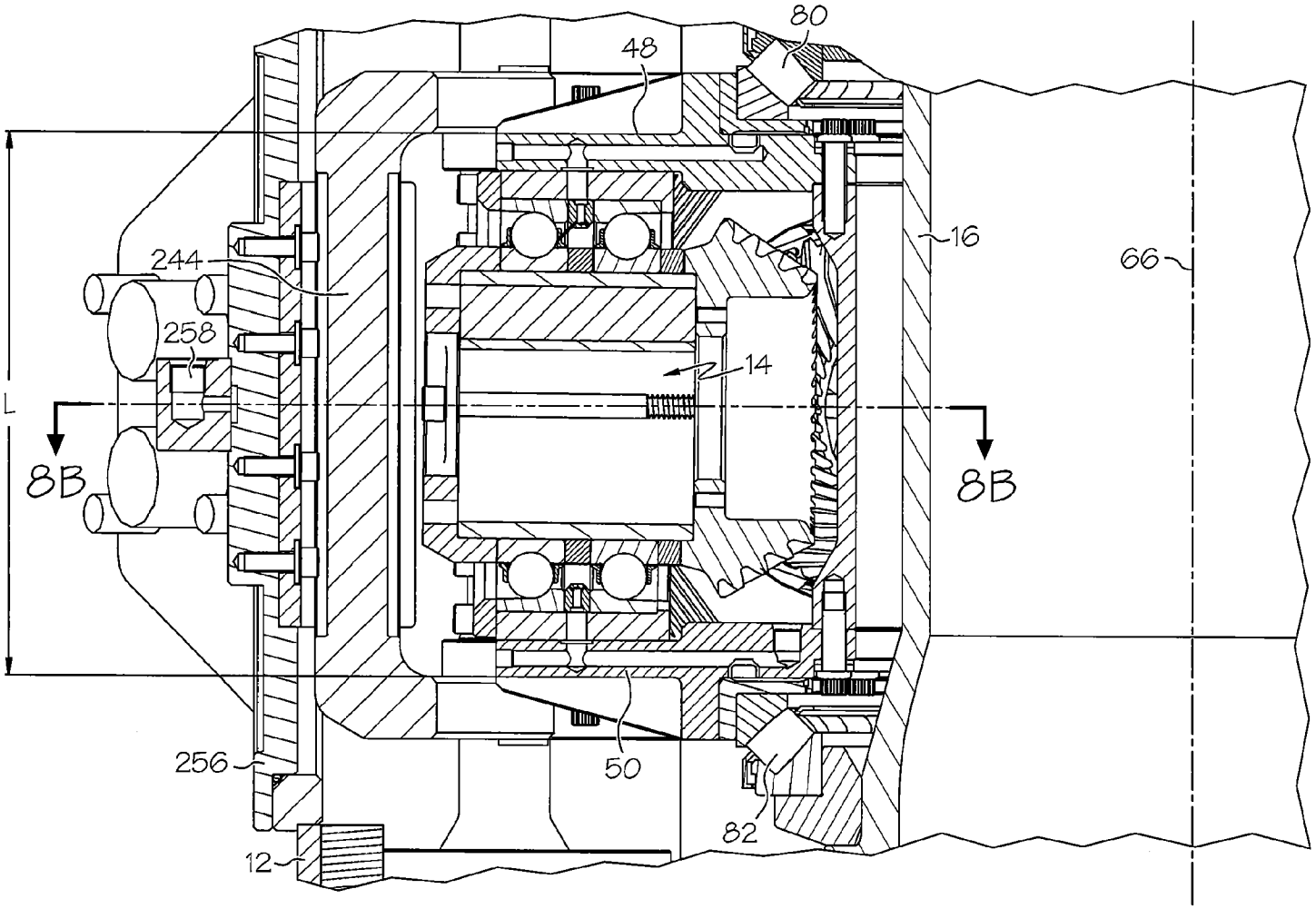
FIG. 8A is a cross-sectional view of an anti-rotation assembly in accordance with one embodiment of the present invention.
Figure 8B:
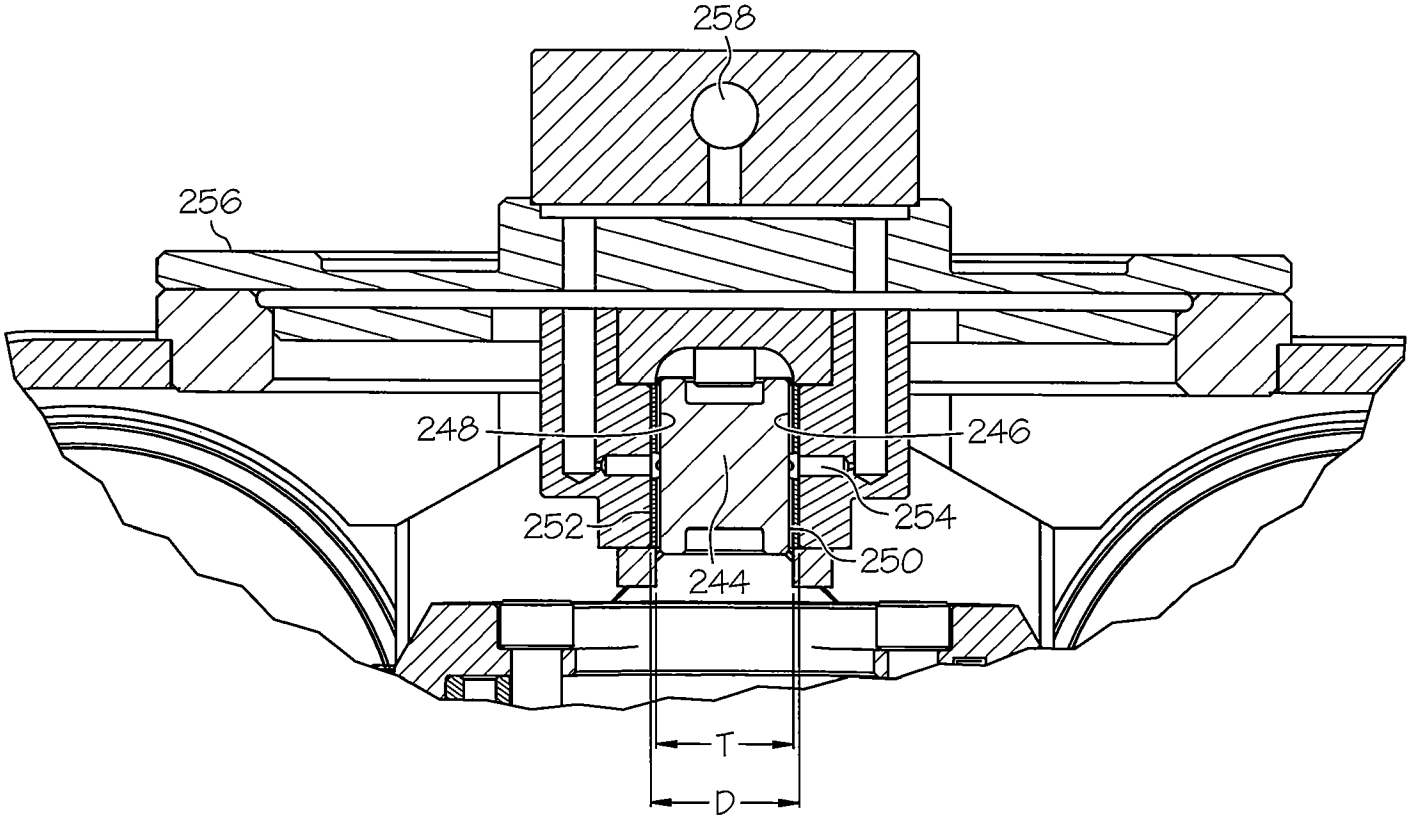
FIG. 8B is a cross-sectional view taken along the line 8B-8B of an anti-rotation assembly in accordance with the embodiment shown in FIG. 8A.

An embodiment of the sonic drill head 10 of the present invention illustrated in FIGS. 8A and 8B may further include at least one anti-rotation assembly 242 to resist torsion forces developed in spindle bearings 80, 82 and thereby prevent rotational displacement of sine generator 14. Anti-rotation assembly 242 includes a reaction bar 244 coupled to upper sine generator plate 48 and lower sine generator plate 50, a first substantially vertical bearing pad 246 and a second substantially vertical bearing pad 248 opposite said first bearing pad 246 separated by a distance D. Reaction bar 244 includes a first substantially vertical face 250, a second substantially vertical face 252 opposite first vertical face 250, a thickness T of material defined by first vertical face 250 and second vertical face 252, and a length L. Length L is generally such that reaction bar 244 spans continuously between upper and lower sine generator plates 48 and 50. Thickness T is generally slightly less than distance D such that reaction bar 244 slides vertically between first bearing pad 246 and second bearing pad 248, but substantial horizontal movement of reaction bar in both directions is resisted by bearing pads 246 and 248. First and second vertical faces 250, 252 of reaction bar 244 are cast or machined smooth so as to easily slide vertically relative to first and second bearing pads 246, 248 thereby allowing substantially frictionless vertical displacement of sine generator 14 relative to outer housing 12.

First bearing pad 246 engages first vertical face 250 of reaction bar 244 and second bearing pad 248 engages second vertical face 252 of reaction bar 244 to prevent rotation of the sine generator 14 within outer housing 12 due to the friction of spindle bearings 80, 82 when spindle 16 is rotating. In one embodiment, first bearing pad 246 and second bearing pad 248 are supplied with lubricating oil through an oil inlet hole 254 within the pad. The oil inlet hole 254 communicates with a plurality of serrations or channels (not shown) in first and second bearing pads 246, 248. The serrations or channels distribute the oil uniformly over the entire surface of interaction between bearing pads 246, 248 and vertical faces 250, 252 of reaction bar 244. First bearing pad 246 and second bearing pad 248 are coupled to anti-rotation housing 256. Anti-rotation housing 256 is generally coupled to outer housing 12 as shown. An external hose 258 and pump (not shown) supplies the lubricating oil to first and second bearing pads 246 and 248. Thus, anti-rotation assembly 242 allows for virtually frictionless vertical translation of sine generator 14 relative to outer housing 12, yet effectively prevents sine generator 14 from rotating about spindle axis 66 due to the frictional resistance of spindle bearings 80, 82.

From the foregoing, it may be seen that the sonic drill head of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

We claim:

1. A vibratory drill head comprising:

a housing;

a spindle mounted to said housing for axial rotation, said spindle presenting a passage therethrough extending between upper and lower ends of said spindle to allow materials to move through said spindle;

a sine generator in said housing coupled to said spindle between said upper end and said lower end of said spindle in a manner to apply a sinusoidal vibration to said spindle, wherein said sine generator comprises six eccentric rotors radially distributed about a center point, each said rotor having an eccentric weight, wherein all said eccentric weights reach top dead center and bottom dead center simultaneously, wherein each of said six eccentric rotors include an axis of rotation, wherein the six axes of rotation are spaced radially equidistant, and wherein each of said axes of rotation are tilted from horizontal; and an isolation mechanism in said housing acting between said sine generator and said housing to dampen the effect on said housing of the sinusoidal vibration applied to said spindle by said sine generator.

2. A vibratory drill head according to claim 1 wherein each of said eccentric rotors includes an inside face wherein said inside faces of said six eccentric rotors substantially define an aperture and said spindle passes through said aperture.

3. A vibratory drill head according to claim 1 wherein said spindle protrudes outside said housing.

4. A vibratory drill head according to claim 1 wherein said material is selected from the group consisting of cuttings, instrumentation, and drill tooling.

5. A vibratory drill head according to claim 1 wherein rotation of said spindle about a spindle axis is effected independently of the operation of said sine generator.

6. A vibratory drill head according to claim 1 wherein said spindle being adapted for connection to a drill bit to effect a sonic drilling mode when said spindle is driven at a first speed and a rotary drilling mode when said spindle is driven at a second speed greater than said first speed.

7. A vibratory drill head according to claim 1 wherein said spindle rotates independently of said sine generator.

8. A vibratory drill head according to claim 7 further comprising an anti-rotation assembly to prevent rotational displacement of said sine generator.

* * * * *